United States Patent [19]

Ausiello et al.

[11] Patent Number: 4,997,133

[45] Date of Patent: Mar. 5, 1991

[54] ELECTROMAGNETICALLY-CONTROLLED FUEL INJECTION VALVE FOR I.C. ENGINES

[76] Inventors: Francesco P. Ausiello, Corso Ferrucci 48, 10138 Torino; Mario Ricco, Via Ferrannini 10, 70125 Bari; Sergio Turchi, Via Bussoleno 16, 10040 Rivalta (Torino), all of Italy

[21] Appl. No.: 476,127

[22] Filed: Feb. 5, 1990

Related U.S. Application Data

[63] Continuation of Ser. No. 236,469, Aug. 25, 1988, abandoned.

[30] Foreign Application Priority Data

Aug. 25, 1987 [IT] Italy ..... 67738 A/87

[51] Int. Cl.[5] ..... F02M 41/16

[52] U.S. Cl. ..... 239/585; 239/96; 251/30.02; 251/30.05

[58] Field of Search ..... 239/95, 585, 533.2, 239/96, 533.3, 533.4; 251/30.01, 30.05, 30.02; 137/625.65

[56] References Cited

U.S. PATENT DOCUMENTS

| | | | |
|---|---|---|---|
| 2,556,369 | 6/1951 | Hogeman | 239/96 |
| 3,464,627 | 9/1969 | Huber | 239/96 |
| 3,661,183 | 5/1972 | Komaroff et al. | 137/625.65 |
| 3,665,353 | 5/1972 | Campbell . | |
| 3,680,782 | 8/1972 | Monpetit et al. | 239/533.8 |
| 4,349,152 | 9/1982 | Akagi | 239/96 |
| 4,674,688 | 6/1987 | Kanesaka | 239/96 |
| 4,848,658 | 7/1989 | Aketa et al. | 239/96 |

FOREIGN PATENT DOCUMENTS

| | | | |
|---|---|---|---|
| 0199632 | 10/1986 | European Pat. Off. . | |
| 1170210 | 5/1964 | Fed. Rep. of Germany | 251/30.01 |
| 1439514 | 6/1970 | Fed. Rep. of Germany . | |
| 2051944 | 5/1971 | Fed. Rep. of Germany . | |
| 2046153 | 3/1972 | Fed. Rep. of Germany . | |
| 2756088 | 6/1979 | Fed. Rep. of Germany . | |
| 3137761 | 3/1983 | Fed. Rep. of Germany | 239/585 |
| 1240067 | 7/1960 | France . | |
| 842238 | 7/1960 | United Kingdom . | |
| 1536689 | 12/1978 | United Kingdom . | |
| 2155693 | 9/1985 | United Kingdom . | |

*Primary Examiner*—Andres Kashnikow
*Assistant Examiner*—Christopher G. Trainor
*Attorney, Agent, or Firm*—Dowell & Dowell

[57] ABSTRACT

An electromagnetically-controlled fuel injection valve for diesel engines includes an electromagnetic metering valve which controls communication between a control chamber supplied with fuel under pressure through an inlet hole, and a discharge hole. The solenoid metering valve includes a ball obturator movable in a cavity of the body defined by two annular valve seats of which the first defines the discharge hole and the second communicates with the inlet hole. The cavity is in communication with the control chamber through lateral passages. The ball obturator is kept in a closed position against the second seat by means of an electromagnetically-operated axial push rod.

1 Claim, 2 Drawing Sheets

ELECTROMAGNETICALLY-CONTROLLED FUEL INJECTION VALVE FOR I.C. ENGINES

Figure 1:
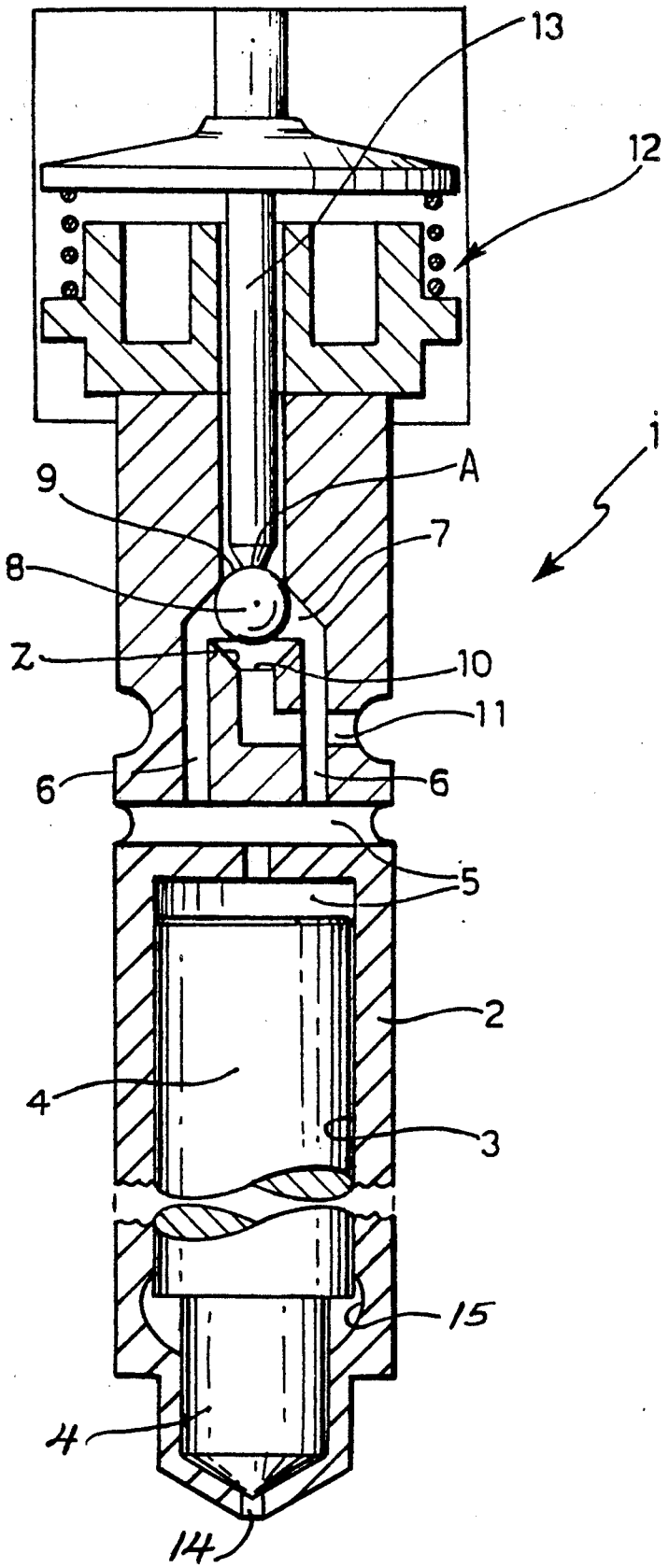

This application is a continuation of application Ser. No. 07/236,469, filed Aug. 25, 1988.

The present invention relates in general to electromagnetically-controlled fuel injection valves for i.c. engines, particularly for diesel engines.

More particularly, the invention concerns an injection valve of the type including a body carrying a lower injection nozzle with which is operatively associated a needle controlling communication between the nozzle and an injection chamber communicating with a passage for the supply of fuel under pressure, and an upper electromagnetic metering valve which controls communication between a control chamber to which fuel is supplied under pressure through an inlet hole to keep the needle in the closed position, and a discharge hole the opening of which causes a pressure drop in the control chamber and consequent opening of the needle.

In injection valves of the above-defined type known, for example, from German patent application No. 19 33 489, the solenoid metering valve is usually provided with an obturator pin arranged simply to close and open the discharge hole. The control chamber is therefore constantly supplied with fuel under pressure (even when the discharge hole is in the open condition) and this, aside from involving relatively long opening times for the needle as a result of the slow drop in pressure in the control chamber upon opening of the discharge hole, can also cause anomalies in operation of the injection valve.

The use of three-way metering valves is also known (for example, from German patent application No. 2051944) but these are structurally complex and require very large control volumes. Moreover, the pressures necessary for fuel injection are in some cases (diesel injection) so high (up to 100 MPa) that a huge hydraulic recirculation is given rise to, and also very high currents are required for operation, so as to prevent industrial use of the above-mentioned three-way valves owing to the excessive electrical power needed.

The object of the present invention is to avoid the above problems and this object is achieved by virtue of the fact that the solenoid metering valve includes a ball obturator which is movable in a cavity of the body defined by first and second annular valve seats aligned along the axis of the injection valve, of which the first defines the discharge hole and the second communicates with the inlet hole, the cavity being in communication with the control chamber through lateral passages, and the ball obturator being kept in a closed position against the first seat and being movable into a closed position against the second seat upon the opening of the discharge hole, by means of an electromagnetically-operated axially sliding push rod, wherein the force required for operation of the valve, rapidly decreasing with the solenoid stroke, is intentionally associated with the force delivered by the solenoid due to the current pulse fed thereto.

By virtue of this concept, during the stage of opening of the needle, the control chamber is isolated from the fuel supply so that the pressure within it is almost instantaneously annulled. This enables on the one hand the opening time of the injection valve to be considerably reduced, and on the other hand the manner of its opening to be adapted more effectively to the characteristics of excitation of the coil of the solenoid valve, which provide for an initial strong pulse of current followed by a period of quite low average intensity. In fact, after its separation from the annular seat defining the discharge hole, the subsequent travel of the ball obturator and its rod takes place with decreasing resistance by virtue of the rapid pressure drop within the control chamber. At the end of its stroke, the ball obturator is kept in the position of closure of the inlet hole with a low expenditure of energy on the part of the electromagnet, by virtue of the very small air gap which exists when the ball obturator is in this position.

The conformation of the solenoid metering valve according to the invention also ensures "fail-safe" conditions in the event of damage or failure of any component of the injection valve, since in this eventuality the ball obturator prevents accidental opening of the injection valve.

Figure 2:
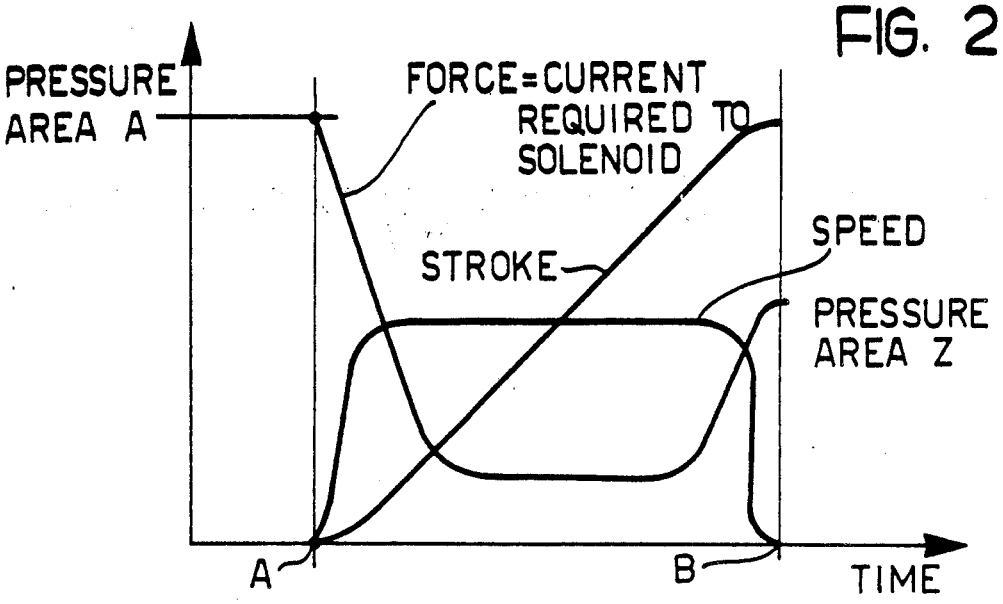
Figure 3:
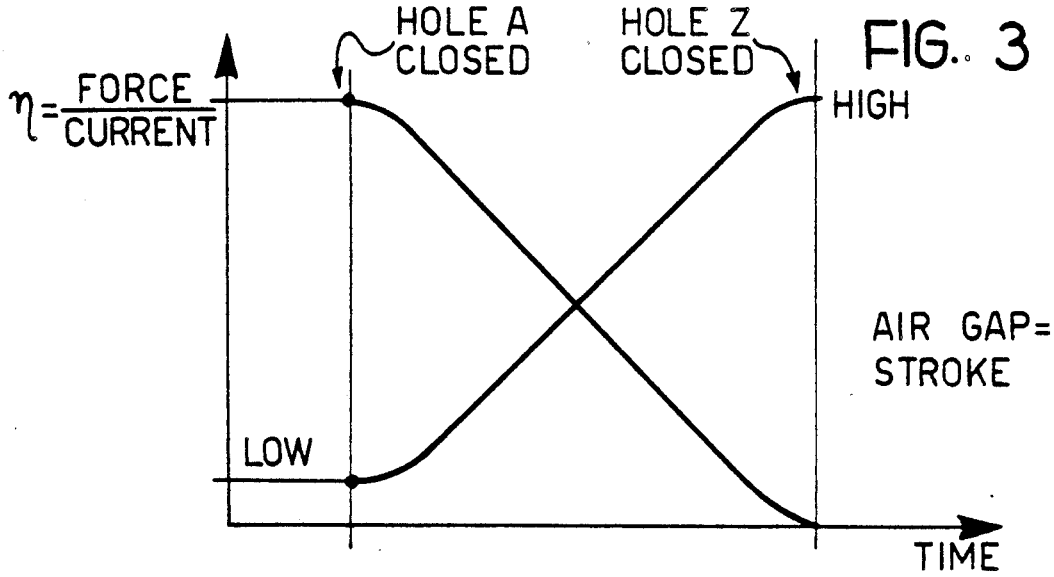
Figure 4:
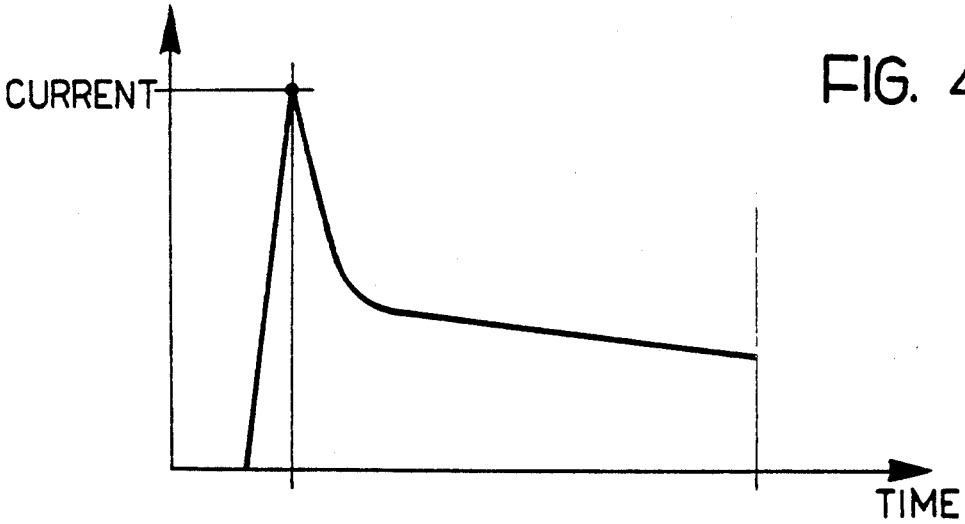

Further characteristics and advantages of the invention will become clear from the detailed description which follows with reference to the appended drawings, provided by way of non-limiting example, in which:

FIG. 1 shows part of an injection valve according to the invention schematically and in longitudinal section, and FIGS. 2, 3 and 4 are three graphs illustrating the operation of the valve.

With reference to FIG. 1, the upper part of an electromagnetically-controlled fuel injection valve for diesel engines is generally indicated 1 and comprises essentially a body 2 forming at its lower end an injection nozzle 14 the opening and closing of which is controlled by a needle 4 which slides axially within a cavity 3 of the body 2 and whose upper part is indicated 4. The needle 4 controls communication between the injection nozzle 14 and an injection chamber 15 communicating with a passage for the supply of pressurised fuel: these parts are not illustrated but are well known, for example, from the aforementioned German patent application No. 19 33 489.

The upper region of the cavity 3 of the body 2 defines a control chamber 5 which communicates through lateral passages 0 with a cavity 7 of the body 2 within which a ball obturator B is movable. The cavity 7 is defined by two annular valve seats A, Z aligned along the axis of the injection valve 1, of which the lower one, indicated Z, defines an inlet hole 10 communicating with a passage 11 for the supply of pressurised fuel.

The obturator B forms part of a solenoid metering valve 12 whose excitation coil cooperates with an axial push rod 13 operatively associated with the ball obturator 8.

The configuration illustrated in the drawing corresponds to the de-energised condition of the solenoid valve 12, in which the ball obturator 8 is closed onto the upper valve seat, obturating the passage through the discharge hole 9 and keeping communication between the cavity 7 and the inlet hole 10 open. The ball obturator 8 is kept in this position by virtue of the fuel pressure within the cavity 7, with the possible help of a weak thrust spring not illustrated in the drawing. In this situation, the needle is kept in the lowered position in which the injection valve 1 is closed, thus preventing the flow of the pressurised fuel contained in the injection chamber through the injection nozzle.

When the solenoid valve 12 is energised, the rod 13 moves axially downwards to move the ball obturator 8 away from the upper valve seat A and cause closure of the lower valve seat Z. In this way, communication between the control cavity 7 and the discharge hole 9 is established, whilst communication between this cavity 7 and the inlet hole 10 is simultaneously closed. The pressure within the control cavity 7 thus drops suddenly, enabling the needle 4 to rise and hence the injection nozzle to open extremely rapidly.

It should be noted that the stroke of the ball obturator 8 corresponding to the opening of the discharge hole 9 takes place with decreasing resistance, which accords well with characteristics of excitation of the coil of the solenoid valve 12 that provide for an initial strong pulse of current followed by a period of quite low average current intensity. Amongst other things this enables the use of discharge holes 9 and inlet holes 10 which have larger sections than those of conventional injection valves. Moreover, when the ball obturator 8 closes the inlet hole 10 at the end of its stroke, the force necessary to keep it in this position is provided by the electromagnet with a low expenditure of energy, by virtue of the very small air gap which exists in this condition, as can be seen from the graphs of FIGS. 2, 3 and 4.

We claim:

1. A fuel injection valve for diesel engines, comprising an elongated hollow body carrying at one end an injection nozzle, an injection chamber in said body for supplying fuel under pressure, a needle having one end operatively associated with said nozzle and axially slidable into said body from a closed position to an open position for controlling communication between said nozzle and said injection chamber, a control chamber in said body located in correspondence with another end of said needle opposite to said nozzle, a passage in said body having an axial portion for supplying fuel under pressure from a fuel supply to said control chamber to normally hold said needle in said closed position by the action of said fuel under pressure, and an electromagnetic metering valve for controlling communication between said control chamber and said axial portion, said metering valve including:

A solenoid secured to said body, an armature movable in said body from a rest position to an operated position upon energization of said solenoid, spring means urging said armature toward said rest position, a cavity in said body defined by first and second annular valve seats coaxial with said portion, said first valve seat defining an outlet hole of said cavity, the opening of which causes a pressure drop in said control chamber, said pressure drop causing a displacement of said needle to said open position, said second valve seat defining an inlet hole between said passage and said cavity, at least a lateral duct between said cavity and said control chamber, a ball obturator axially movable in said cavity and normally urged by said fuel under pressure to close said outlet hole and to open said inlet hole, current pulse generating means for energizing said solenoid, said current pulse including an initial pulse portion of high intensity followed by a pulse portion of low average intensity, and a push rod secured to said armature and operatively associated with said ball obturator, said armature upon energization of said solenoid causing said push rod to positively move said ball obturator so as to open said outlet hole and to close said inlet hole, whereby said control chamber is isolated from said fuel supply and the pressure therein is almost instantaneously annulled.

* * * * *

UNITED STATES PATENT AND TRADEMARK OFFICE

CERTIFICATE OF CORRECTION

PATENT NO. : 4,997,133

DATED : March 5, 1991

INVENTOR(S) : Ausiello, Francesco Paolo, et al

It is certified that error appears in the above-identified patent and that said Letters Patent is hereby corrected as shown below:

ON THE TITLE PAGE

Item [73] Assignee: insert --Weber S.r.l., Torino, Italy--.

Before item [57] Abstract, change "Attorney, Agent, or Firm: Dowell and Dowell" to read --Attorney, Agent or Firm: Dvorak and Traub--.

Signed and Sealed this

Seventh Day of January, 1992

*Attest:*

HARRY F. MANBECK, JR.

*Attesting Officer*

*Commissioner of Patents and Trademarks*